United States Patent [19]

Caldwell et al.

[11] 4,018,239

[45] Apr. 19, 1977

[54] TRAY WASHER APPARATUS

[75] Inventors: Frank J. Caldwell, West Carrollton; Thomas B. Heckman, Troy, both of Ohio

[73] Assignee: Hobart Corporation, Troy, Ohio

[22] Filed: Nov. 17, 1975

[21] Appl. No.: 632,869

[52] U.S. Cl. ..... 134/143; 134/144; 134/154; 134/165; 134/200; 312/229; 312/272

[51] Int. Cl.[2] ..... B08B 3/02

[58] Field of Search ..... 134/57 DL, 58 DL, 144, 134/165, 199, 200, 143, 154, 182–183; 312/229, 272–273

[56] References Cited

UNITED STATES PATENTS

| | | | |
|---|---|---|---|
| 3,288,154 | 11/1966 | Jacobs | 134/200 X |
| 3,590,863 | 7/1971 | Faust et al. | 134/165 X |
| 3,655,942 | 3/1971 | Tomsic | 219/405 |
| 3,768,493 | 10/1973 | Kraeft | 134/199 X |
| 3,844,299 | 10/1974 | Athey et al. | 134/57 D |
| 3,908,681 | 9/1975 | Schimke et al. | 134/200 X |

*Primary Examiner*—Robert L. Bleutge
*Attorney, Agent, or Firm*—Biebel, French & Nauman

[57] ABSTRACT

A machine for washing articles which are of greater height than width dimension when supported by an article receiving rack includes a cabinet of generally rectangular horizontal cross-section capable of accommodating the horizontal dimensions of the rack. The cabinet defines a washing chamber and a front access opening of sufficient height to accommodate lateral movement of a rack containing upright articles into the washing chamber. A lower door is pivotally mounted on the cabinet adjacent to the lower edge of the access opening for movement from a vertical closed position to a horizontal open position. The lower door includes a rack supporting surface and is dimensioned to correspond in size to the rectangular horizontal cross-section of the cabinet. An upper door is mounted for vertical movement from a lower position covering the remaining upper portion of the access opening to an upper position uncovering the upper portion of the access opening. A mechanical linkage interconnects the upper and lower doors and coordinates opening and closing movement of the doors. The lower edge of the access opening and the lower edge of the lower door define a vent opening which permits pressure equalization between the washing chamber and the exterior of the washer. A C-shaped lip along the lower edge of the lower door directs fluid sheeting down the inner surface of the door inwardly to prevent fluid from being expelled through the vent opening.

5 Claims, 5 Drawing Figures

FIG-3
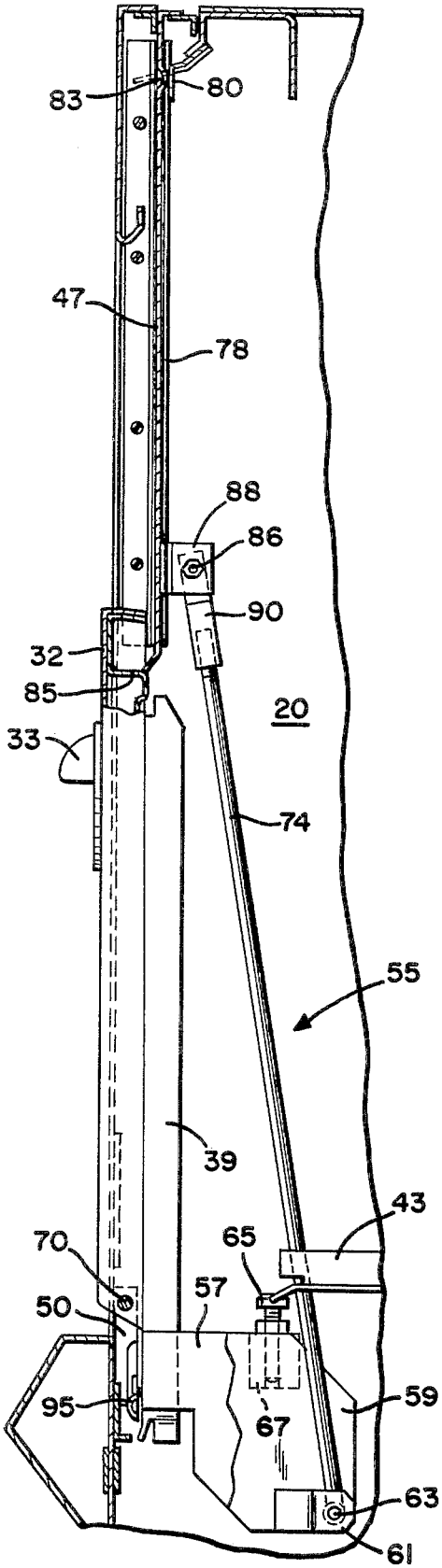
FIG-4
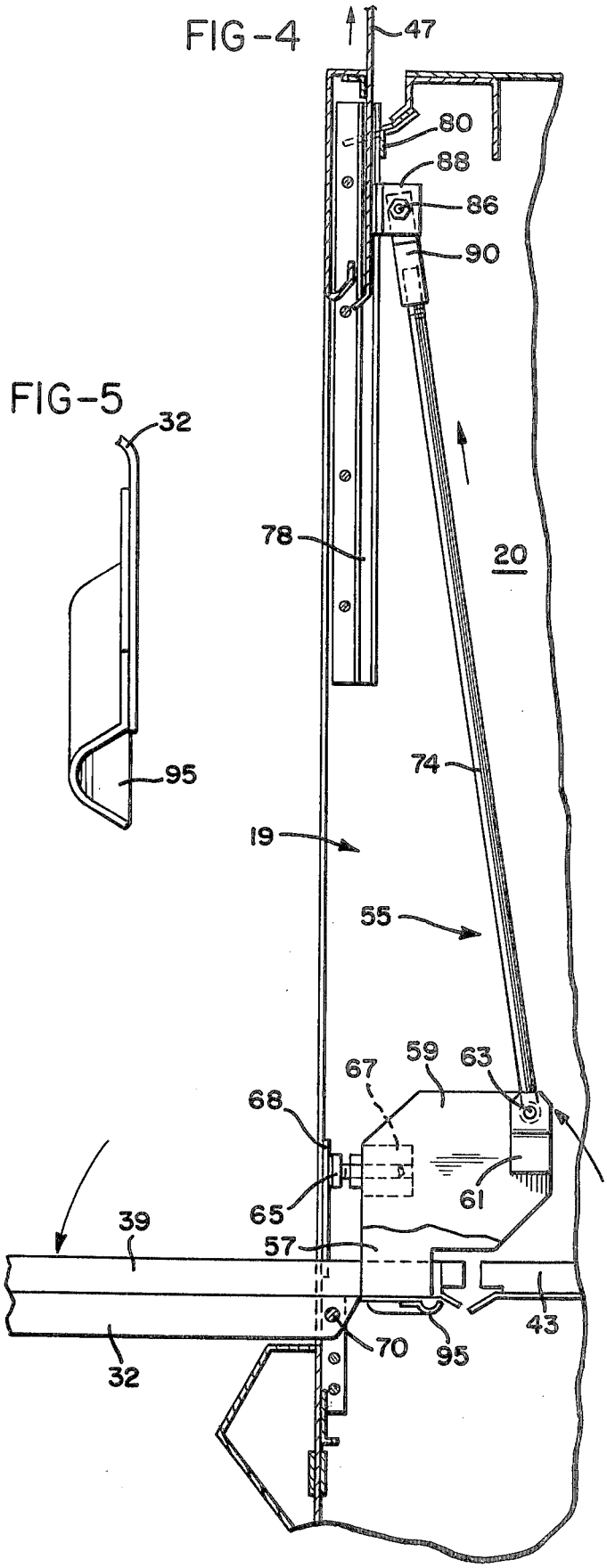
FIG-5

TRAY WASHER APPARATUS

BACKGROUND OF THE INVENTION

The present invention relates to a machine for washing articles and more particularly to a machine useful in washing large trays or similar items. Supermarkets, bakeries and delicatessens typically display food products in glass cases with various products placed upon a number of large metal or plastic trays. These large trays are unusually difficult to clean since they will not fit into ordinary automated washing apparatus. The trays must therefore be washed by hand or by special washing apparatus having an access opening and washing chamber which are sufficiently large. Typically, space limitations in bakeries, delicatessens, and supermarkets are rather severe. Therefore, the door arrangement covering the access opening of such special washing apparatus must not obstruct an undue amount of space in front of the washer when the device is being loaded with trays. A downwardly opening door is desirable, though, to provide a platform for supporting a tray rack while the rack is loaded.

An additional problem with washers having a downwardly opening door and a vent opening beneath the door is the splashing of hot washing fluid through the vent opening at the initiation of each washing operation. As one rack of trays is removed and replaced by another in the washing chamber, the hot vapor laden air is replaced by cooler, drier room air. If the door is then closed and the washing cycle initiated, two things occur. First, water is sprayed on all the walls of the washing chamber and runs down the sides in sheets. The sheet of water on the inside of the door would normally drop from the bottom of the door into the bottom of the washing chamber. However, at the beginning of the washing operation, a sudden increase in pressure within the chamber occurs due to the rapid increase in temperature of the air within the chamber when the air is mixed with the hot wash water. This sudden pressure change typically will blow the sheet of water dropping from the bottom of the front door through the vent opening. Attempts to solve this problem by bending the bottom lip of the door inwardly have been unsuccessful since such a lip will interfere with the sliding of a tray rack into and out of the washing chamber.

One approach which could be taken to cover the large access opening required in a device of this type would be to use a single large downwardly opening door. Such a door when in its opened position would interfere with the utilization of space in front of the access opening. Closure mechanisms such as shown in U.S. Pat. No. 1,253,356 to Delaney, issued Jan. 15, 1918 and U.S. Pat. No. 2,288,482 to Plohberger, issued June 30, 1942, while providing large access openings, are not useful with a washing device. This is because a device for washing large items must have spray arms both above and below the washing chamber and such a closure mechanism would interfere with the operation of the upper spray arms.

U.S. Pat. No. 2,860,026 to Long, issued Nov. 11, 1958, shows a double door arrangement which, while allowing a large access opening to be utilized, is unacceptable in a washer environment in that a door does not open downwardly in front of the washer to provide a rack supporting surface for loading and unloading. U.S. Pat. No. 3,655,942 to Tomsic, issued Apr. 11, 1972, does disclose a double door arrangement with one door opening downwardly; however, the two doors are utilized to close the same opening in an oven, the second door being used as a heat shield.

In U.S. Pat. No. 3,049,391 to Meeker et al., issued Aug. 14, 1962, and assigned to the assignee of the present invention, a two-door closure is shown for a washing machine having a vertically enlarged washing chamber. The washer is designed to accommodate large "hotel" trays. The closure disclosed has a lower door panel which is hinged to the lower edge of an upper door panel. The lower door panel moves upwardly with the upper door panel and also swings outwardly to uncover completely the access opening to the washing chamber. While this door arrangement uses a minimum of the space surrounding the washer, it does not provide a surface for supporting a rack during loading and unloading. Separate rack supporting structure must therefore be provided.

SUMMARY OF THE INVENTION

In accordance with the present invention, a machine for washing upright articles which are of greater height than width dimensions when supported by an article receiving rack includes a cabinet of generally rectangular cross-section. The cabinet encloses and defines a washing chamber of sufficient dimensions to accommodate the upright articles to be washed and further defines a front access opening of height and width capable of accommodating lateral movement of the rack containing the upright articles into the washing chamber. Spray apparatus is provided in the washing chamber above and below the access opening for spraying wash solution and rinse water onto the articles. Horizontal rack receiving tracks in the chamber extend to positions adjacent the sides of the lower edge of the access opening. A lower door is pivotally mounted on the cabinet adjacent to the lower edge of the access opening for movement from a first vertical position in which the lower door covers a lower portion of the access opening to a second horizontal position uncovering the lower portion of the access opening. This lower door includes a rack supporting surface and is dimensioned to correspond in size to the rectangular cross-section of the cabinet. An upper door is mounted for vertical movement from a first lower position covering the remaining upper portion of the access opening to a second upper position uncovering the upper portion of the access opening.

A linkage interconnects the upper and lower doors and coordinates the movement of the doors. A stop mechanism for holding the lower door in its second horizontal, open position may be provided. The linkage applies a force to the lower door to hold it in its first vertical, closed position due to the weight of the upper door on the linkage. The linkage may comprise a plate rigidly attached to the lower door and a linkage rod pivotally attached to the plate. The other end of the linkage rod is pivotally attached to the upper door.

The lower edge of the access opening and the lower edge of the lower door define a vent opening communicating between the washing chamber and the outside atmosphere. A C-shaped lip along the lower edge of the lower door directs fluid inwardly to prevent splashing of wash fluid through the vent opening at the beginning of each wash operation.

Accordingly, it is an object of the present invention to provide a washing device having a washing chamber with a height dimension which is greater than its width or depth dimension and which has an access opening and a closure for such opening corresponding in height to the height of the washing chamber; to provide such a device in which the closure occupies minimal space in front of said access opening when said access opening is uncovered; to provide such a device in which the closure includes a lower door and an upper door which are linked together to coordinate movement; to provide such a device in which the linkage between the upper door and the lower door applies a force to the lower door tending to keep it closed; and, to provide such a device having a vent opening beneath its lower door and a C-shaped water deflecting lip adjacent the bottom edge of the lower door.

Other objects and advantages of the present invention will be apparent from the following description, the accompanying drawings, and the appended claims.

BRIEF DESCRIPTION OF THE DRAWINGS

FIG. 3 is an enlarged partial section of the washing device taken generally along the line 3—3 in FIG. 2 with the access opening closed;

FIG. 4 is a view similar to FIG. 3 with the access opening uncovered; and

FIG. 5 is an enlarged partial view of the lower portion of the lower door.

DETAILED DESCRIPTION OF THE INVENTION

Figure 1:
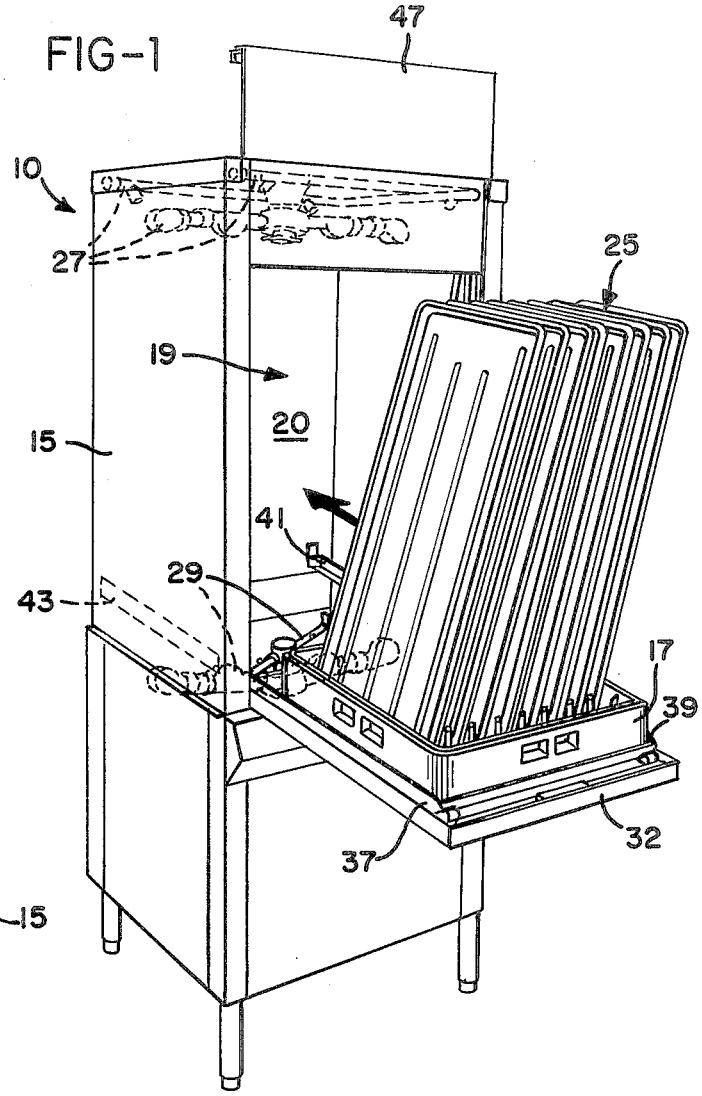
FIG. 1 is a perspective view of a washing device of the present invention with a rack of trays ready to be moved into the washing chamber.
Figure 2:
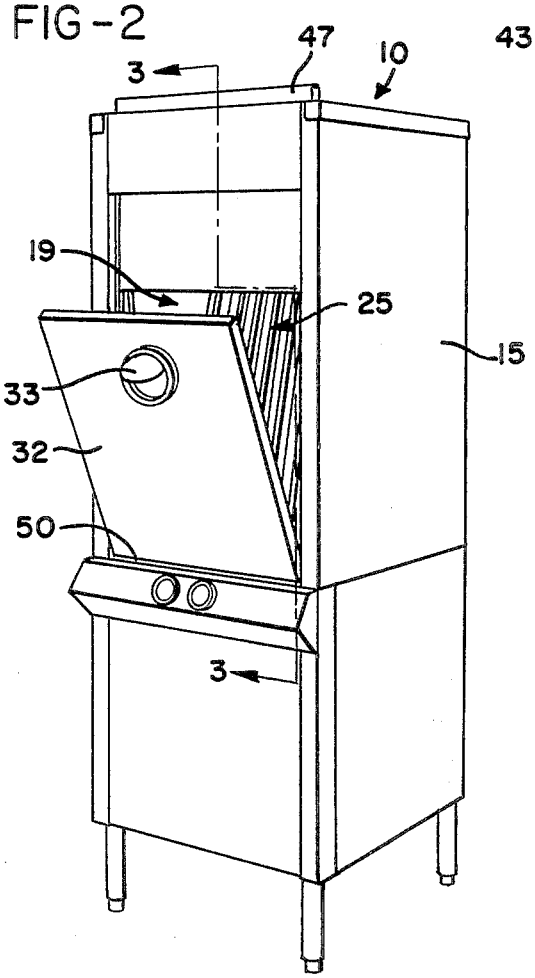
FIG. 2 is a perspective view of a washing device of the present invention with the access opening to the washing chamber partially closed.

Referring now to FIGS. 1 and 2, there is shown in perspective a washing device of the present invention. Washer 10 comprises a cabinet 15 of generally rectangular horizontal cross-section capable of accommodating the dimensions of a rack 17. The rack 17 is movable through a front access opening 19 into a washer chamber 20 defined by cabinet 15.

Washer 10 is designed to accommodate upright articles, such as trays 25, which are of greater height than width dimensions when supported by article receiving rack 17. Access opening 19 is therefore dimensioned to be capable of accommodating lateral movement of rack 17 carrying trays 25 into washing chamber 20. While the washer 10 is specifically designed to be capable of handling over-sized trays, as shown in FIG. 1, it should be understood that a variety of smaller articles may also be washed with this washer. Spray apparatus 27 and 29 in washing chamber 20 above and below access opening 19 is provided for spraying wash solution and rinse water on the articles in wash chamber 20. Rinse and spray apparatus of the type used is shown in U.S. Pat. No. 3,844,299 to Athey et al., issued Oct. 29, 1974.

Lower door 32 including handle 33 is pivotally mounted on cabinet 15 adjacent to the lower edge of access opening 19 for movement from a first vertical closed position in which the lower door covers a lower portion of access opening 19 to a second horizontal, open position (shown in FIG. 1) uncovering the lower portion of access opening 19. As seen in FIG. 1, the lower door 32 includes a rack supporting surface means such as tracks 37 and 39. Horizontal rack receiving tracks 41 and 43 in chamber 20 extend to positions adjacent the sides of the lower edge of access opening 19. Door 32 is dimensioned to correspond in size to the rectangular horizontal cross-section of cabinet 15.

Upper door 47 is mounted for vertical movement from a first lower position covering the remaining portion of access opening 19, to a second upper position, shown in FIG. 1, uncovering the upper portion of access opening 19. Doors 32 and 47 are interconnected by a linkage, described below, which coordinates movement of the doors such that they open and close simultaneously. The washing machine 10 is vented for the purpose of equalizing pressure between its interior and exterior by means of a vent opening (not shown) at the rear of the cabinet. Additionally a vent opening 50 is provided along the lower edge of the lower door 32.

Referring now to FIGS. 3 and 4, linkage means 55 interconnecting the upper door 47 and the lower door 32 coordinates the movement of these doors between their respective first and second positions. Linkage means 55 will be described with respect to a configuration attached to one side of the doors 32 and 47; however, it should be understood that an identical linkage configuration is attached to both sides of the doors. The linkage means is configured such that if lower door 32 is pivoted outwardly and downwardly from its first vertical closed position as seen in FIG. 3, upper door 47 moves from its first lower closed position shown in FIG. 3 to a second upper position shown in FIG. 4 in which the upper portion of access opening 23 is uncovered.

In FIGS. 3 and 4, door 32 and track 41 are shown in elevation. Additionally, plate 57 is shown partially broken away to reveal plate 59 attached to the opposite side of door 32. Plate 59 is attached to bracket 61 by pivot 63. Threaded bolt 65 is engaged by threaded block 67 and acts as an adjustable stop mechanism. As seen in FIG. 4, stop plate 68 is struck by bolt 65 and prevents further pivoting of door 32 when the door moves into its horizontal position. As door 32 pivots about hinge point 70, pivot 63 and the end of linkage rod 74 are raised. This causes upper door 47 to slide vertically in tracks 78 and thus uncover the upper portion of access opening 19.

The weight of upper door 47 acting on linkage 74 causes a force moment to be applied to plate 59. This force moment tends to rotate lower door 32 about hinge point 70 in a clockwise direction. When the door 32 is in its open position as shown in FIG. 4, this force moment will be more than counterbalanced by the weight of door 32. When, however, the lower door 32 is closed, the clockwise force moment will be sufficient to keep the door 32 closed without any additional latching arrangement. A secure closure of access opening 19 will therefore be maintained even when sudden pressure changes occur during a washing cycle in washing chamber 20. It may be desirable in some applications to positively lock the closure arrangement during a washing cycle. A solenoid actuated pin (not shown) cooperating with a hole in upper door 47 may be used to provide such positive locking.

Upper door 47 when lowered effectively covers the upper portion of the access opening 19. A wiper flange 80 is positioned to co-act with ridge 83 in door 47 to form an effective seal along the upper edge of door 47. As seen in FIG. 3, doors 32 and 47 overlap slightly when in their closed positions with the bottom edge of door 47 and door element 85 abutting and acting as a seal. Rod 74 is pivotally attached to door 47 by pivot 86 on bracket 88. Rod 74 is threaded into connector 90 so as to allow adjustment of the range of vertical movement of upper door 47. As seen in FIG. 4 tracks 39 and 43 are flared outward slightly at their ends to ensure a smooth sliding action for a rack 17 as it is moved into and out of chamber 20.

Referring now to FIG. 5, there is shown an enlarged fragmentary view of the C-shaped lip 95 which is attached to the bottom of door 32. As seen in FIG. 3, a vent opening 50 between the bottom of door 32 and the bottom edge of access opening 19 allows pressure to be equalized between washing chamber 20 and the exterior of the machine. At the start of each washing cycle, hot washing fluid is sprayed into cavity 20. The fluid immediately begins to sheet down the interior walls of the washing chamber which include the back of door 32. Interior pressure is also suddenly increased due to the increase in chamber air temperature when the air in the chamber 20 is mixed with the hot wash fluid. The C-shaped lip 95 directs inwardly the water sheeting down the interior surface of door 32 so that it is not blown out of vent 50. Although a simple inward bend in the bottom of door 32 might accomplish the same result, such an arrangement would interfere with tracks 37 and 39 and the sliding of racks 17 into and out of the chamber 20 through opening 19. For this reason it is significant that, as seen in FIG. 4, the lip 95 does not extend above the level of track 32.

While the present invention is highly advantageous when used to wash large items such as the trays described previously, it should be understood that the present invention is also useful in washing items which could be accommodated by a washer of conventional size and construction. The present invention may therefore be used as an all-purpose washing device.

While the form of apparatus herein described constitutes a preferred embodiment of the invention it is to be understood that the invention is not limited to this precise form of apparatus, and that changes may be made therein without departing from the scope of the invention.

What is claimed is:

1. A machine for washing upright articles which are of greater height than width dimensions when supported by an article-receiving rack, comprising:

a cabinet of generally rectangular horizontal cross-section capable of accommodating the horizontal dimensions of a rack, said cabinet enclosing and defining a washing chamber and also defining a front access opening of height and width capable of accommodating lateral, unobstructed movement of a rack containing said upright articles therethrough into said washing 10 chamber, spray apparatus in said washing chamber above and below said access opening for spraying wash solution and rinse water onto articles in said washing chamber, horizontal rack receiving tracks in said chamber 15 extending to positions adjacent the sides of the lower edge of said access opening, a lower door pivotally mounted on said cabinet adjacent to the lower edge of said access opening for movement from a first vertical, closed position in which said lower door covers a lower portion of said access opening to a second horizontal, open position uncovering said lower portion of said access opening, said lower door including a rack supporting surface means, and said door dimensioned to correspond in size to said rectangular horizontal cross-section of said cabinet, guide track members mounted above said lower door and extending vertically upward therefrom along the sides of said access opening, an upper door mounted for vertical sliding movement along said guide track members from a first lower position covering the remaining upper portion of said access opening to a second upper position uncovering said upper portion of said access opening, and means interconnecting said upper door and said lower door and coordinating the movement of said upper door and said lower door between their respective first and second positions, such that a large access opening is provided permitting a rack resting on said lower door and loaded with the upright articles to be moved horizontally onto said rack receiving tracks in said washing chamber when said upper door means and said lower door means are in their respective second positions, and further said access opening is completely covered when said upper door means and said lower door means are in their respective first positions.

2. A machine as defined in claim 1 wherein said means interconnecting said upper door and said lower door and coordinating the movement between said upper door and said lower door between their respective first and second positions includes a stop mechanism for holding said lower door in its said second position.

3. A machine as defined in claim 1 in which said lower edge of said access opening and the lower edge of said lower door define a vent opening and further in which said lower door comprises a C-shaped lip along its lower edge to direct fluid sheeting down the inner surface of said lower door inwardly such that no fluid is expelled through said vent opening.

4. A machine as defined in claim 1 in which said means interconnecting said upper door and said lower door and coordinating the movement between said upper door and said lower door between their respective first and second positions applies a force to said lower door to hold said lower door in its first vertical, closed position due to the weight of said upper door.

5. A machine as defined in claim 4 in which said means interconnecting said upper door and said lower door and coordinating the movement between said upper door and said lower door between their respective first and second positions comprises a plate rigidly attached to said lower door and a linkage rod pivotally attached to said plate and pivotally attached to said upper door.

* * * * *

UNITED STATES PATENT AND TRADEMARK OFFICE

CERTIFICATE OF CORRECTION

PATENT NO. : 4,018,239

DATED : April 19, 1977

INVENTOR(S) : Frank J. Caldwell and Thomas B. Heckman

It is certified that error appears in the above-identified patent and that said Letters Patent are hereby corrected as shown below:

Column 5, line 55, "10" should be deleted.

Column 5, line 60, "15" should be deleted.

Signed and Sealed this

Twenty-first Day of June 1977

[SEAL]

*Attest:*

RUTH C. MASON
*Attesting Officer*

C. MARSHALL DANN
*Commissioner of Patents and Trademarks*